United States Patent [19]

Takenaka

[11] 4,218,634

[45] Aug. 19, 1980

[54] ELECTRON GUN

[75] Inventor: Shigeo Takenaka, Fukaya, Japan

[73] Assignee: Tokyo Shibaura Denki Kabushiki Kaisha, Kawasaki, Japan

[21] Appl. No.: 949,418

[22] Filed: Oct. 3, 1978

[30] Foreign Application Priority Data

Oct. 5, 1977 [JP] Japan ..... 52-118963
Nov. 14, 1977 [JP] Japan ..... 52-135648

[51] Int. Cl.[2] ..... H01J 29/46; H01J 29/56
[52] U.S. Cl. ..... 315/16; 313/449
[58] Field of Search ..... 315/14, 15, 16, 382, 315/31 TV; 313/414, 449

[56] References Cited

U.S. PATENT DOCUMENTS 2,559,526 7/1951 Van de Graaff et al. ..... 315/16
3,417,199 12/1968 Yoshida et al. ..... 315/14
3,772,554 11/1973 Hughes ..... 313/414 X
3,932,786 1/1976 Campbell ..... 313/449 X

*Primary Examiner*—Theodore M. Blum
*Attorney, Agent, or Firm*—Cushman, Darby & Cushman

[57] ABSTRACT

An electron gun comprising a plurality of focusing grids spatially arranged along the path of an electron beam generated from a cathode and each bored with at least one opening for allowing the passage of the electron beam, wherein at least one of said plural focusing grids is formed of at least one electrode set at a grounding potential or a lower potential than a focusing voltage and at least one more electrode whose potential is defined by an electrostatic capacity; and a high voltage is produced to provide an electron lens, though enabling the electron lens to improve its performance without being obstructed by requirements associated with the construction of a picture tube.

2 Claims, 7 Drawing Figures

ELECTRON GUN

BACKGROUND OF THE INVENTION

This invention relates to an electron gun for generating one or more electron beams and more particularly to an electron gun provided with means for effectively focusing the electron beams on a target.

With the ordinary color picture tube provided with a multi-beam electron gun designed to generate a plurality of electron beams, the respective electron beams pass through separate electron lenses to be focussed at a point on a target. The electron lens is generally formed of a static electric field to focus the electron beams at a single point. The static electric field is formed at right angles to an electron beam path, and is disposed between at least two electrodes each bored with an opening allowing the passage of an electron beam. The properties of the electron lens can generally be varied according to interelectrode voltage, the size of an opening bored in the electrodes and a distance therebetween.

The electron gun is generally regarded to have a more improved performance, according as the electron lens is more reduced in the degree of magnification and spherical aberration. To provide an electron gun of high quality, therefore, it is necessary to extend the focal length of the electron lens. The most effective process to attain this object is to vary interelectrode voltage. However, the level of the interelectrode voltage should generally be restricted to fall within such a range as prevents arcing from taking place at the base portion of a picture tube. Further, enlargement of an electrode opening to extend the focal length of the electron lens is subject to certain limitations, because the neck diameter of the picture tube is restricted by other electrical requirements. Moreover, extension of the interelectrode distance is not advisable since the properties of the electron lens are harmfully affected by a electric charge occurring in the neck portion of the picture tube and the generation of an unnecessary electric field in the electron gun. As mentioned above, the design of the electron lens is subject to limitations due to various physical requirements associated with the construction of a picture tube. These limitation are particularly rigid in the case of a color picture tube using a multi-beam electron gun.

The customary process of manufacturing an electron lens having a long focal length without being obstructed by the above-mentioned limitations is to combine properly interelectrode voltage and the kind of electrode. An electron gun constructed by the above-mentioned process has already beam set forth in the Japanese patent disclosures Nos. 76072/1976 and 77061/1976.

However, the disclosed processes have the drawbacks that the electron gun unavoidably has a complicated construction and extra voltage has to be applied to improve the formation of an electron lens, thus leading to economic disadvantage. For elevation of the performance of an electron lens, it is necessary to apply high voltage with respect to not only the electron guns used in the above-mentioned disclosed processes but also electron guns in general use. In such a case, a special device has to be provided to suppress arcing which might otherwise occur in the base portion of a picture tube in order to ensure its reliable operation, thus rendering the picture tube more expensive.

SUMMARY OF THE INVENTION

It is accordingly the object of this invention to provide an electron gun admitting of the elevation of the performance of an electron lens without being obstructed by requirements associated with the construction of a picture tube.

According to this invention, there is provided an electron gun comprising a plurality of focusing grids spatially arranged along the path of an electron beam generated from a cathode and each bored with at least one opening for allowing the passage of the electron beam, wherein at least one of said plural focusing grids is formed of at least one electrode set at a grounding potential or a lower potential than the focusing voltage and at least one more electrode whose potential is defined by an electrostatic capacity.

DESCRIPTION OF THE PREFERRED EMBODIMENTS

For an electron gun embodying this invention, there is applied an entirely novel process never known to date which utilizes an electrostatic capacity of an electrode to apply voltage on said electrode. Therefore, an electron lens can be designed to act as a high voltage electrode, though actually a much lower voltage is externally applied.

Figure 1A:
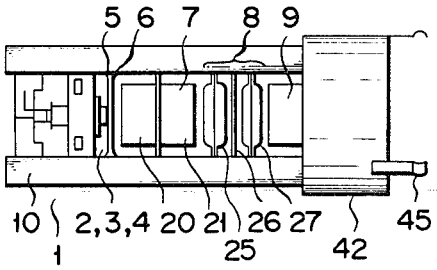
FIG. 1A is a front view of an electron gun according to one embodiment of this invention.
Figure 1B:
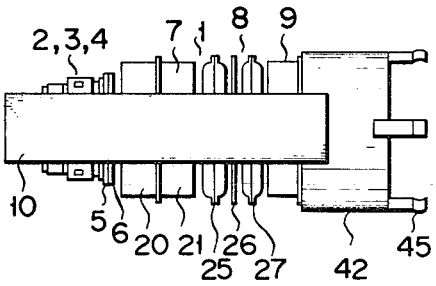
FIG. 1B is a plan view of the electron gun of FIG. 1A.
Figure 2:
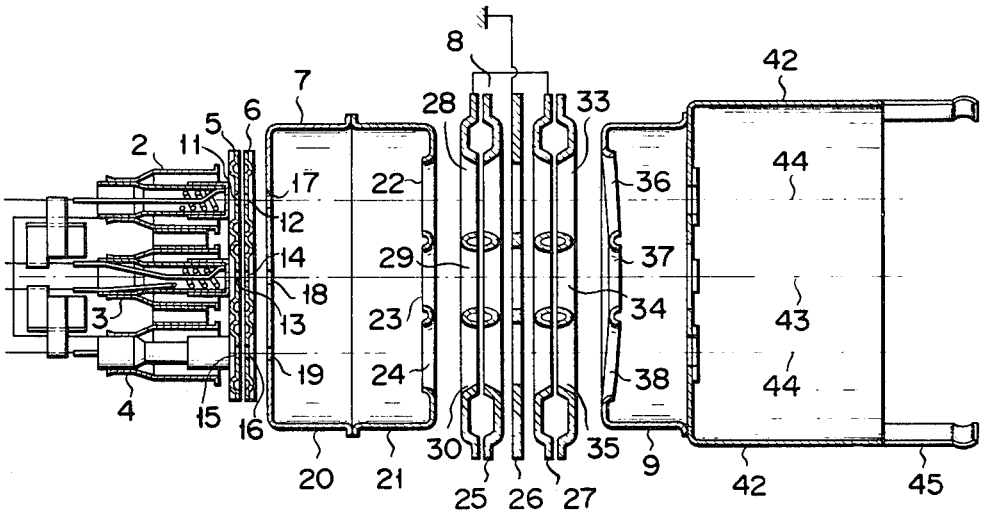
FIG. 2 is a sectional view of the electron gun of FIG. 1A.

There will now be described by reference to the accompanying drawing the cases where this invention is applied to a uni-potential type electron gun and a bi-potential type electron gun. Description is first given of the case where this invention is applied to the uni-potential type electron gun. FIGS. 1A, 1B and 2 are respectively a front view, plan view and sectional view of an in-line type electron gun used with a color picture tube. An electron gun 1 comprises a plurality of electrodes and glass supports thereof. The plural electrodes constitute these cathodes 2, 3, 4, first grid 5, second grid 6, third grid or first focusing grid 7, fourth grid or third focusing grid 8 and fifth grid or second focusing grid 9. These grids are fitted to the glass supports 10 in the order mentioned as counted from the cathode side. The cathodes 2, 3, 4, send forth electron beams along three paths lying on the same plane. The first grid 5 and second grid 6 are flat electrodes closely facing each other and are respectively bored with a group of three openings 11–12–13 and another group of three openings 14–15–16 which are aligned with the three electron beam paths. The third grid or first focusing grid 7 is positioned adjacent to the second grid 6. The grid 7 is formed of a pair of cups 20, 21 joined with each other on the peripheral edges of the openings thereof. The bottoms of said cups 20, 21 are respectively bored with a group of three openings 17–18–19 and another group of three openings 22, 23, 24 which are aligned with the three electron beam paths. The openings 17, 18, 19 of the first cup 20 have a larger diameter than the openings 14, 15, 16 of the second grid 6. The openings 22, 23, 24 of the second cup 21 have a larger diameter than the openings 17, 18, 19 of the first cup 20. The fourth grid or third focusing grid 8 is formed of at least three auxiliary electrodes 25, 26, 27. The first electrode 25 and third electrode 27 are respectively formed of a pair of cups joined with each other. Both electrodes 25, 27 are respectively bored with a group of three openings 28–29–30 and another group of three openings 33–34–35 which are aligned with the three electron beam paths. Said electrodes 25, 27 are electrically connected together to have the same potential, and spatially arranged along the electron beam paths. Provided between the electrodes 25, 27 is a plate-shaped second electrode 26, which is also bored with three openings aligned with the three electron beam paths. The fifth grid or second focusing grid 9 is cup-shaped, spaced from the fourth grid 8 substantially as much as a distance between the third grid 7 and fourth grid 8, and also bored with three openings 36, 37, 38. The central opening 37 is aligned with the axis 43 of the central opening of the first grid 5 to that of the fourth grid 8. But the other openings 36, 38 are respectively slightly displaced outward from the axes 44 of the side openings of the first grid 5 to that of the fourth grid 8. The displacement is intended to cause two electron beams other than the central one to be slightly deflected by an asymmetrical electric field in order to converge the three electron beams at a single point on a target. The fifth grid or second focusing grid 9 is fitted with a cylindrical shield cup 42 whose bottom is bored with three openings aligned with the three electron beam paths. A plurality of bulb spacers 45 made of a metal strip are mounted on the edge of the open side of the cylindrical shield cup 42.

The grids of the electron gun are spaced from each other as follows.

| | |
|---|---|
| A distance between the third grid or first focusing grid 7 and the first electrode 25 of the fourth grid or third focusing grid 8 | about 1 mm |
| A distance between the third electrode 27 of the fourth grid or third focusing grid 8 and the fifth grid or second focusing grid 9 | about 1 mm |
| A distance between the second electrode 26 and the first electrode 25 of the fourth grid or third focusing grid 8 | about 0.6 mm |
| A distance between the second electrode 26 and the third electrode 27 of the fourth grid or third focusing grid 8 | about 0.6 mm |

The third grid 7 and fifth grid 9 are electrically connected together to have the same potential. The second electrode 26 of the fourth grid 8 is electrically insulated from the first electrode 25 and third electrode 27 of said fourth grid 8, and is set at a grounding potential or externally applied with a prescribed value of voltage when the electron gun is put into operation. However, the first electrode 25 and third electrode 27 of said fourth grid 8 are not externally supplied with any voltage.

When an electron gun is built in a picture tube, the bulb spacers 45 are pressed against the inner wall of the picture tube, thereby electrically connecting the fifth grid 9 to the inner wall of the picture tube. During the operation of the electron gun, the third grid 7 and fifth grid 9 are applied with voltage of about 25 to 30 kv through the inner wall of the picture tube. The second electrode 26 of the fourth grid 8 is grounded through the base portion of the picture tube. At the time, the first electrode 25 and third electrode 27 of the fourth grid 8 are naturally applied with voltage of about 10 kv. The reason why this voltage is naturally generated in the first and third electrodes 25, 27 of the fourth grid 8 may be explained as follows by reference to the equivalent circuit of FIG. 3.

Figure 3:
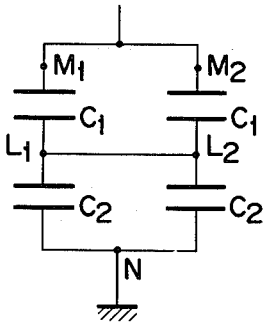
FIG. 3 shows an equivalent circuit of the electron gun of FIG. 2.

Two capacitors $C_1$ of FIG. 3 are respectively formed between the third grid 7 and the first electrode 25 of the fourth grid 8, and also between the third electrode 27 of the fourth grid 8 and fifth grid 9. Two other capacitors $C_2$ are produced between the first and second electrodes 25, 26 of the fourth grid 8, and also between the second and third electrodes 26, 27 of said fourth grid 8.

Referring to the equivalent circuit of FIG. 3, the two capacitors $C_1$ and the two other capacitors $C_2$ are respectively connected in series. The character $M_1$ denotes the third grid 7; the character $M_2$ the fifth grid 9; the charactor $L_1$ the first electrode 25; the character $L_2$ the third electrode 27; and the character N the second electrode 26. Where voltage of, for example, 25 kv is applied on the third grid 7 or $M_1$ and the fifth grid 9 or $M_2$, and the second electrode 26 or N is set at a grounding potential, then voltage corresponding to the capacities of two capacitors $C_1$, $C_2$ constituting one set is generated in the first electrode 25 or $L_1$, and voltage corresponding to the capacities of two capacitors $C_1$, $C_2$ constituting another set is generated in the third electrode 27 or $L_2$. The capacities of the capacitors $C_1$, $C_2$ are defined only by a distance between the respective electrodes constituting said capacitors, if the electrodes have substantially the same shape. Where, therefore, levels of voltage being applied on the first and third electrodes 25, 27 of the fourth grid 8 are selected in designing an electron gun, then a ratio which a distance between the electrodes constituting the capacitor $C_1$ bears to a distance between the electrodes constituting the capacitor $C_2$ is defined. Conversely speaking, where the ratio between said distances is chosen, then values of voltage applied on the first and third electrodes 25, 27 of the fourth grid 8 are determined. Values of the above-mentioned voltage and distance are practically decided as follows. An electron gun in which all the electrodes constituting the fourth grid 8 have the same potential represents the ordinary uni-potential type. Where this type of electron gun is designed by setting the focusing voltage (voltage impressed on the fourth grid 8) at 10 kv when voltage of 25 kv is applied on the third and fifth grids 7, 9, then it is advised to set a distance between the first and second electrodes 25, 26 of the fourth grid 8 and that between the second and third electrodes 26, 27 thereof and ground the second electrode 26. Assuming that a distance between the third grid 7 and first electrode 25, and a distance between the fifth grid 9 and third electrode 27, that is, distances between the electrodes respectively constituting the two capacitors $C_1$ are chosen to be 1 mm, then a distance between the first and second electrodes 25, 26 of the fourth grid 8 and a distance between the second and third electrodes 26, 27 thereof, that is, distances between the electrodes respectively constituting the two other capacitors $C_2$ are calculated to be 0.67 mm, as measured from the following equation:

$$\frac{10(kv)}{25(kv) - 10(kv)} \times 1 \text{ mm} = 0.67 \text{ mm}$$

Figure 4:
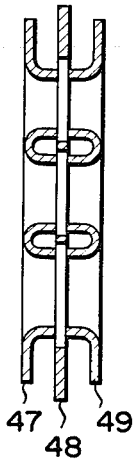
FIG. 4 is a sectional view of a modification of a fourth focusing grid used with the electron gun of FIG. 2.

What should be taken into consideration in adopting the above-mentioned method of designing an electron gun, is to prevent the potential of the second electrode 26 of the fourth grid 8 from exerting a harmful effect on an electron lens. Namely, it is necessary, for example, to bore the second electrode 26 of the fourth grid 8 with three openings larger than those of the first and third electrode 25, 27 thereof and, where required, construct the fourth grid 8 as illustrated in FIG. 4, thereby preventing an electrostatic field created by the second electrode 26 from substantially exerting a harmful effect on the function of an electron gun particularly, an electron lens. The fourth grid of FIG. 4 is formed of a first electrode 47, second electrode 48 and third electrode 49. The peripheral edges of the three openings bored in the first electrode 47 and those of the third electrode 49 projects towrard the second electrode 48. If however, an electrostatic field generated in the neighborhood of the second electrode does not substantially exert any harmful effect on the function of an electron lens, then it is unnecessary to construct the fourth grid 8 as shown in FIG. 4. It is obviously possible positively to utilize an electrostatic field produced in the proximity of the second electrode 48. In such case, the interelectrode distance can not be determined by the previously described method.

Rigidly speaking, an electrostatic capacity is not defined solely by a distance between two mutually facing electrodes or other factors thereof, but is actually affected by the properties of other electrodes and earth capacity. Practically, therefore, a proper interelectrode distance has to be experimentally determined.

Figure 5:
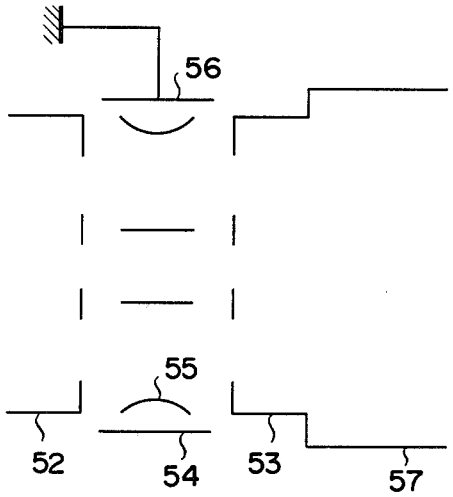
FIG. 5 schematically illustrates a modification of the electron gun of FIG. 1.

FIG. 5 schematically shows the arrangement of a modification of focusing means used with an electron gun embodying this invention. This focusing means is formed of a first focusing grid 52, second focusing grid 53 and third focusing grid 54. The first focusing grid 52 is bored with three openings aligned with three electron beam paths. The second focusing grid 53 is bored, like the first focusing grid 52, with three openings aligned with three electron beam paths, and further fitted with a shield cup 57. The third focusing grid 54 is formed of an inner annular auxiliary electrode 55 disposed substantially halfway between the first and second focusing grids 52, 53 along an electron beam path and an outer annular auxiliary electrode 56 positioned coaxially with the inner annular auxiliary electrode 55 spatially to surround it. The inner annular auxiliary electrode 55 is not externally impressed with voltage. The outer annular auxiliary electrode 56 is set at a grounding potential. With the focusing means of the above-mentioned construction, the potential of the inner annular auxiliary electrode 55 is substantially defined by an electrostatic capacity generated between the first and second focusing grids 52, 53 and an electrostatic capacity produced between the inner annular auxiliary electrode 55 and outer annular auxiliary electrode 56.

Figure 6:
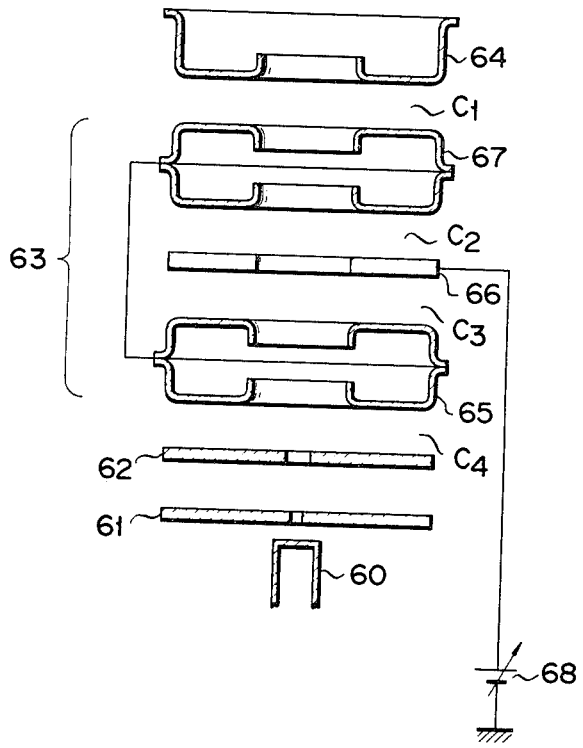
FIG. 6 is a sectional view of an electron gun according to another embodiment of this invention.

The foregoing description relates to the case where this invention was applied to a uni-potential type electron gun. There will now be described by reference to FIG. 6 the case where the invention is applied to a bi-potential type electron gun. The electron gun of FIG. 6 comprises a cathode 60, first grid 61, second grid 62, first focusing grid 63 and second focusing grid 64 which are arranged in the order mentioned as counted from the cathode side, and each bored with one opening aligned with a common electron beam path. The first focusing grid 63 is formed of at least three electrodes, namely, first electrode 65, second electrode 66 and third electrode 67. With a bi-potential type electron gun constructed as described above, the second focusing grid 64 is applied with the final electron beam-accelating voltage (for example, 25 kv) of a picture tube. The second grid 62 is generally applied with voltage of about 500 v. With the ordinary bi-potential type electron gun, the first focusing grid 63 is applied with voltage of 3 to 4 kv. With a bi-potential type electron gun embodying this invention, however, it is only necessary to impress low voltage of, for example, 500 v or grounding voltage on the second electrode 66 and connect together the first and third electrodes 65, 67 disposed on both sides of the second electrode 66 with the same potential. Namely, the first and third electrodes 65, 67 are not externally impressed with any voltage. The potential of the mutually connected first and third electrodes 65, 67 is defined by the potentials of the second focusing grid 64, second electrode 66 and second grid 62 and the capacitances $C_1$, $C_2$, $C_3$, $C_4$ generated between the respective electrodes (FIG. 6). The interelectrode distance is determined by the similar method to the aforementioned embodiment. Since the capacitances $C_1$ to $C_4$ vary with the shape of the corresponding electrodes, it should be defined with said variation taken into account.

With the bi-potential type electron gun of FIG. 6 embodying this invention, a sort of uni-potential electrostatic lens is formed in the first focusing grid 63. Therefore, electron beams are subjected to a certain degree of focusing while passing through the openings of the first focusing grid 63, thereby improving the focusing property of the bi-potential type electron gun of FIG. 6 over that of a similar type of electron gun in which the above-mentioned uni-potential electrostatic lens is not produced. Unless required, it is obviously possible to change that portion of the first focusing grid 63 in which the above-mentioned uni-potential electrostatic lens is produced into such shape as prevents electron beams from being focusing.

As described above, this invention makes it possible to elevate electron lens-forming voltage whose level has hitherto been subject to certain limitations due to requirements associated with the construction of a picture tube, thereby improving the function of the electron lens.

Namely, with the electron gun of this invention, high electrode voltage is indeed applied to increase the performance of an electron lens. To this end, however, much lower voltage has only to be externally applied, thereby eliminating arcings at the base portion of a picture tube which have hitherto raised problems. Further advantages of the invention are that since an external power source need not generate high voltage, the arrangement of a picture tube circuit is simplified, decreasing the power consumption of said circuit; and since the base portion of the picture tube is not applied with high voltage, the picture tube can be operated more reliably, making it possible to design the base portion so as to ensure the reduction of cost. With the first embodiment of FIG. 2 relative to a uni-potential type electron gun, the second electrode 26 was set at a grounding potential. With the second embodiment of FIG. 6 relative to a bi-potential type electron gun, the second electrode 66 is impressed with low voltage of, for example, 500 v. With either type of electron gun, the second electrode may be set at a grounding potential or be impressed with low voltage. Where, as show in FIG. 6, the second electrode is set at a grounding potential, provision of a variable capacitor 68 between the second electrode 66 and the grounding electrode outside of the picture tube makes it possible to control focusing voltage, if necessary. Further, insertion of a high resister between the second electrode and grounding electrode, though not changing the focusing voltage, has the advantage that should a arcing take place in a picture tube, said high resistor acts as a damping resistor, minimising the generation of arc current and saving the cathode from damage and other difficulties.

The first embodiment relates to a uni-potential type electron gun provided with three in-line cathodes. The second embodiment relates to a bi-potential type electron gun comprising a single cathode. Obviously the type of electron gun and that of cathode can be freely combined. The point is that this invention is applicable to any type of electron gun, provided the focusing electrode or grid can be used as a capacitor type. With the foregoing embodiments, electrodes aligned with electron beam paths were utilized as the capacitor electrodes. However, application of this invention need not be limited to such type of electron gun. Namely, the electron gun of, for example, FIG. 2 may comprise a second cylindrical electrode which encloses a fourth grid and is bored with three openings aligned with three electron beam paths. In this case, an electron lens has its inner diameter reduced. Therefore, the electron lens should be constructed in consideration of the result of comparison between the effect of the voltage supplied thereto and the effect of the inner diameter thereof. Obviously, this invention is applicable to a tri-potential type electron gun.

What is claim is:

1. An electron gun comprising a plurality of focusing grids spatially arranged along the path of an electron beam generated from a cathode and each bored with at least one opening for allowing passage of the electron beam, wherein at least one of said plural focusing grids is formed between two other grids and includes a second electrode set at a grounding potential or a lower potential than a focusing voltage, and first and third electrodes arranged on opposite sides of said second electrode along the electron beam path and electrically connected with each other, the potentials of said first and third electrodes being defined by the potentials of said two other grids and the potential of said second electrode and by the capacitance between said first electrode and the adjacent other grid, the capacitance between said first electrode and said second electrode, the capacitance between said third electrode and the adjacent other grid and the capacitance between said third electrode and said second electrode.

2. The electron gun according to claim 1, wherein the second electrode is grounded through a variable capacitor.

* * * * *